US012656001B2

(12) United States Patent
Roman et al.

(10) Patent No.: US 12,656,001 B2
(45) Date of Patent: Jun. 16, 2026

(54) ATTIC VENTILATION SYSTEM, ROOF VENT THEREFOR, AND METHOD OF INSTALLATION AND SERVICING THEREOF

(71) Applicant: 1656975 Ontario Inc, Etobicoke (CA)

(72) Inventors: Roberto Carlos Roman, Etobicoke (CA); Martin Gorlero Correa, Etobicoke (CA); Mathias Alfredo Roman Pon, Etobicoke (CA)

(73) Assignee: 1656975 Ontario Inc (CA)

( * ) Notice: Subject to any disclaimer, the term of this patent is extended or adjusted under 35 U.S.C. 154(b) by 352 days.

(21) Appl. No.: 18/210,195

(22) Filed: Jun. 15, 2023

(65) Prior Publication Data

US 2024/0230118 A1 Jul. 11, 2024

(30) Foreign Application Priority Data

Jan. 6, 2023 (CA) ..... 3186055

(51) Int. Cl.
*F24F 7/02* (2006.01)
*F24F 13/20* (2006.01)
*F24F 5/00* (2006.01)

(52) U.S. Cl.
CPC ..... *F24F 7/025* (2013.01); *F24F 13/20* (2013.01); *F24F 2005/0067* (2013.01)

(58) Field of Classification Search
CPC ..... F24F 7/025; F24F 13/20; F24F 2005/0067
USPC ..... 454/341
See application file for complete search history.

(56) References Cited

U.S. PATENT DOCUMENTS 4,251,026 A 2/1981 Siegel et al.
5,049,801 A 9/1991 Potter
5,078,047 A * 1/1992 Wimberly ..... E04D 13/17 454/366
6,220,956 B1 4/2001 Kilian et al.
(Continued)

FOREIGN PATENT DOCUMENTS

CN 209214059 U * 8/2019 ..... Y02B 10/10
WO 2022211818 A1 10/2022

OTHER PUBLICATIONS

HomeDepot—Broan-NuTone 28 Watt Solar-Powered Black Surface Mount Attic Vent 345SOBK-A, https://www.homedepot.com/p/Broan-NuTone-28-Watt-Solar-Powered-Black-Surface-Mount-Attic-Vent-345SOBK/204070489#overlay, Oct. 26, 2022.
(Continued)

*Primary Examiner* — Avinash A Savani
*Assistant Examiner* — Dana K Tighe
(74) *Attorney, Agent, or Firm* — Price Heneveld LLP

(57) ABSTRACT

Described are various embodiments of an attic ventilation system, a roof vent therefor, and method of installation and servicing thereof. In one embodiment, the roof ventilation system is to be mounted on a roof to draw exhaust airflow therethrough, and comprises a flange portion defining a roof-mountable surface circumscribing an outwardly extending vent channel; and an outer housing disposed atop the flange portion relative to the vent channel obstructing external ingress of precipitation therein, the outer housing comprising operatively externally mounted thereon a solar panel for capturing solar energy, and a fan operatively internally mounted therein powered by the solar energy to draw the exhaust airflow through the vent channel.

25 Claims, 9 Drawing Sheets

(56) References Cited

U.S. PATENT DOCUMENTS

| | | | | |
|---|---|---|---|---|
| 8,123,142 | B2 | 2/2012 | Cislo | |
| 8,368,240 | B1 | 2/2013 | Burkett | |
| 9,494,330 | B2 * | 11/2016 | Bushey | F24S 25/10 |
| 9,719,692 | B2 | 8/2017 | Cislo | |
| 10,970,990 | B1 | 4/2021 | Jacob | |
| 11,105,524 | B2 | 8/2021 | Daniels | |
| 11,175,056 | B1 | 11/2021 | Stevenson et al. | |
| 11,609,015 | B2 | 3/2023 | Stevenson et al. | |
| 11,761,650 | B2 | 9/2023 | Haubrich | |
| 2010/0304660 | A1 | 12/2010 | Boehling et al. | |
| 2010/0330898 | A1 | 12/2010 | Daniels | |
| 2011/0217194 | A1 | 9/2011 | Randall | |
| 2011/0263192 | A1 | 10/2011 | Kouninski | |
| 2012/0178357 | A1 * | 7/2012 | Rheaume | F04D 25/0613 454/343 |
| 2012/0302153 | A1 | 11/2012 | Macioch et al. | |
| 2014/0113542 | A1 | 4/2014 | Foreman et al. | |
| 2015/0079896 | A1 | 3/2015 | Stocker | |
| 2016/0010886 | A1 | 1/2016 | Dukes | |
| 2016/0278517 | A1 | 9/2016 | DeLorean | |
| 2018/0245807 | A1 | 8/2018 | Wright | |
| 2019/0056131 | A1 | 2/2019 | Warren et al. | |
| 2020/0072485 | A1 | 3/2020 | LaPalme | |
| 2021/0270475 | A1 | 9/2021 | Haubrich | |
| 2022/0099317 | A1 | 3/2022 | Mantyla | |
| 2022/0260266 | A1 | 8/2022 | Daniels | |

OTHER PUBLICATIONS

Solar Exhaust Fan Roof Top Ventilation Fan System Square Solar Attic Fan Air Extractor—Buy Solar E, Alibaba.com, Oct. 26, 2022.
Canada Go Green—https://www.bestreviews.guide/solar-powered-roof-vents.

* cited by examiner

ATTIC VENTILATION SYSTEM, ROOF VENT THEREFOR, AND METHOD OF INSTALLATION AND SERVICING THEREOF

FIELD OF THE DISCLOSURE

The present disclosure relates to attic ventilation system, and, in particular, to an attic ventilation system, a roof vent therefor, and method of installation and servicing thereof.

BACKGROUND

Ventilation systems for attics and roofs are commonplace to both bring air into, and allow air to escape from, the attic of a building. For example, various passive and active ventilation systems exist for commercial and residential buildings alike that permit excess heat, for example built up during warm season months, to exhaust from the attic while allowing fresh air to enter and circulate. Active vents may include line or solar powered vents that can be actively powered to exhaust air from the attic and promote healthy airflow.

The following provides some examples of known roof ventilation systems.

U.S. Patent Application Publication No. 2022/0260266 teaches a Roof Vent and Roof Ventilation System with diverters that prevent or reduce the likelihood that water or other debris can be driven through the vent by wind.

U.S. Patent Application Publication No. 2022/0099317 teaches a Hybrid Roof Vent having an air passageway that defines an air to flow path between the interior and the exterior of a building.

U.S. Patent Application Publication No. 2021/0270475 teaches an Attic Ventilation System. U.S. Patent Application Publication No. 2018/0245807 teaches a Solar Powered Roof Ventilation System.

Automated systems are also known.

U.S. Pat. No. 10,970,990 teaches Systems and Methods for Monitoring Building Health that may include various types of sensors, for example, in roofing materials, to transmit an alert or remedial actions as required.

U.S. Pat. No. 11,105,524 teaches an Automatic Roof Ventilation System that includes a vent, a fan, a solar panel, a battery and a controller configured to drive the fan based on at least one environmental parameter.

U.S. Patent Application Publication No. 2011/0263192 teaches an Attic Ventilation System for venting an attic where a central controller is connected to at least one temperature detector located inside the attic, at least one other temperature detector located outside of the attic, at least one attic vent clamp which is located in the roof to permit airflow through the roof when open to facilitate ventilation of the attic space, and at least one attic exhaust fan located within the attic.

This background information is provided to reveal information believed by the applicant to be of possible relevance. No admission is necessarily intended, nor should be construed, that any of the preceding information constitutes prior art or forms part of the general common knowledge in the relevant art.

SUMMARY

The following presents a simplified summary of the general inventive concept(s) described herein to provide a basic understanding of some aspects of the disclosure. This summary is not an extensive overview of the disclosure. It is not intended to restrict key or critical elements of embodiments of the disclosure or to delineate their scope beyond that which is explicitly or implicitly described by the following description and claims.

A need exists for an attic ventilation system, a roof vent therefor, and method of installation and servicing thereof that overcome some of the drawbacks of known techniques, or at least, provides a useful alternative thereto. Some aspects of this disclosure provide examples of such systems, devices and methods.

In accordance with one aspect, there is provided a roof ventilation system to be mounted on a roof to draw exhaust airflow therethrough, comprising: a flange portion defining a roof-mountable surface circumscribing an outwardly extending vent channel; and an outer housing disposed atop said flange portion relative to said vent channel obstructing external ingress of precipitation therein, said outer housing comprising operatively externally mounted thereon a solar panel for capturing solar energy, and a fan operatively internally mounted therein powered by said solar energy to draw said exhaust airflow through said vent channel; wherein said outer housing is dismountably coupled to said flange portion for servicing without dismounting said flange portion from the roof.

In one embodiment, the outer housing comprises an inwardly projecting structure that, when said outer housing is mounted to said flange portion, extends inwardly within said vent channel so to permit said exhaust airflow to flow outwardly through a vent channel volume defined between a vent channel wall and an external surface of said inwardly projecting structure.

In one embodiment, the fan is operatively mounted toward an apex of said inwardly projecting structure to draw said exhaust airflow through said vent channel volume.

In one embodiment, the outer housing further comprises a motor operatively mounted within said inwardly projecting structure and powered by said solar energy to drive said fan through said apex.

In one embodiment, the vent channel wall comprises a set of exhaust airflow apertures defined therein for permitting egress of said exhaust airflow therethrough, and wherein said external surface of said inwardly projecting structure comprises a concave surface shaped to laminarly redirect said exhaust airflow laterally toward said exhaust airflow apertures.

In one embodiment, the inwardly projecting structure is defined by a curved funnel shape that defines said concave surface, and wherein said fan is operatively mounted at said apex to draw said exhaust airflow along said concave surface.

In one embodiment, the exhaust airflow apertures define a set of slits formed toward and around an apex of said vent channel.

In one embodiment, the outer housing comprises a circumscribing skirt extending downwardly around said vent channel beyond said exhaust airflow apertures so to further obstruct external ingress of precipitation therein.

In one embodiment, the vent channel is substantially cylindrical.

In one embodiment, the outer housing is dismountably secured toward an apex of said vent channel such that, upon dismounting of said outer housing, said internally projecting structure can be extracted along therewith from within said vent channel.

In one embodiment, the outer housing is dismountably secured toward an apex of said vent channel such that, upon dismounting of said outer housing, said internally projecting structure can be extracted along therewith from within said vent channel for servicing at least one of said motor or a related drive mechanism without dismounting said flange portion from the roof.

In one embodiment, the fan is dismountably secured to said motor such that it can be dismounted therefrom prior to extraction of said internally projecting structure from said vent channel.

In one embodiment, a serviced outer housing or a new outer housing can be remounted to an installed flange portion.

In one embodiment, the housing defines a cap upon which is operatively mounted said solar panel, and wherein said cap is mounted to an apex of said vent channel.

In accordance with another aspect, there is provided a method for servicing a roof ventilation system operatively mounted on a roof, comprising: dismounting an outer housing of the roof ventilation system from a flange portion thereof without dismounting said flange portion from the roof, wherein said flange portion comprises a roof-mounted surface circumscribing an outwardly extending vent channel that remain mounted to the roof during servicing, and wherein said outer housing comprises an inwardly projecting structure that, when said outer housing is mounted to said flange portion, extends inwardly within said vent channel, and which houses a powered drive mechanism for driving an fan of the roof ventilation system; extracting said inwardly projecting structure from within said vent channel thereby allowing for servicing of the drive mechanism housed therein; reinserting said inwardly projecting structure within said vent channel upon remounting said outer housing post-servicing.

In one embodiment, the fan is operatively mounted at an apex of said inwardly projecting structure, and wherein the method further comprises, prior to said extracting, dismounting said fan from said apex so to permit said extracting.

In one embodiment, the outer housing defines a cap upon which is operatively mounted a solar panel for capturing solar energy, wherein said solar energy powers said powered drive mechanism, and wherein said dismounting comprises dismounting said cap from an apex of said vent channel.

In accordance with another aspect, there is provided a roof vent to be mounted on a roof to draw exhaust airflow therethrough, comprising: a flanged roof-mountable vent channel; an outer housing disposed relative to said vent channel to obstruct external ingress of precipitation therein, said outer housing comprising an inwardly projecting structure that extends inwardly within said vent channel so to permit said exhaust airflow to flow outwardly along an external surface of said inwardly projecting structure; and a fan operatively mounted toward an apex of said inwardly projecting structure to draw said exhaust airflow through said vent channel.

In one embodiment, the outer housing further comprises a motor operatively mounted within said inwardly projecting structure to drive said fan through said apex.

In one embodiment, the external surface of said inwardly projecting structure comprises a concave surface shaped to laminarly redirect said exhaust airflow.

In one embodiment, the inwardly projecting structure is defined by a curved funnel shape that defines said concave surface, and wherein said fan is operatively mounted at said apex to draw said exhaust airflow along said concave surface.

In one embodiment, a circumscribing vent channel wall comprises a set of exhaust airflow apertures defined therein for permitting egress of said exhaust airflow therethrough, wherein said concave surface is shaped to laminarly redirect said exhaust airflow laterally toward said exhaust airflow apertures.

In one embodiment, the exhaust airflow apertures define a set of slits formed toward and around an apex of said vent channel wall.

In one embodiment, the outer housing comprises a circumscribing skirt extending downwardly around said vent channel beyond said exhaust airflow apertures so to further obstruct external ingress of precipitation therein.

In one embodiment, the vent channel is substantially cylindrical.

In one embodiment, the roof vent further comprises a solar panel externally mounted atop said external housing to power said fan.

Other aspects, features and/or advantages will become more apparent upon reading of the following non-restrictive description of specific embodiments thereof, given by way of example only with reference to the accompanying drawings.

BRIEF DESCRIPTION OF THE FIGURES

Several embodiments of the present disclosure will be provided, by way of examples only, with reference to the appended drawings, wherein:

FIG. 6 is a side view of a lower flange portion of the roof vent of FIG. 1, whereas FIG. 6A is an enlarged view of a retention nub for engaging and retaining a top housing of the vent when mounted thereon, in accordance with one embodiment;

Figure 1:
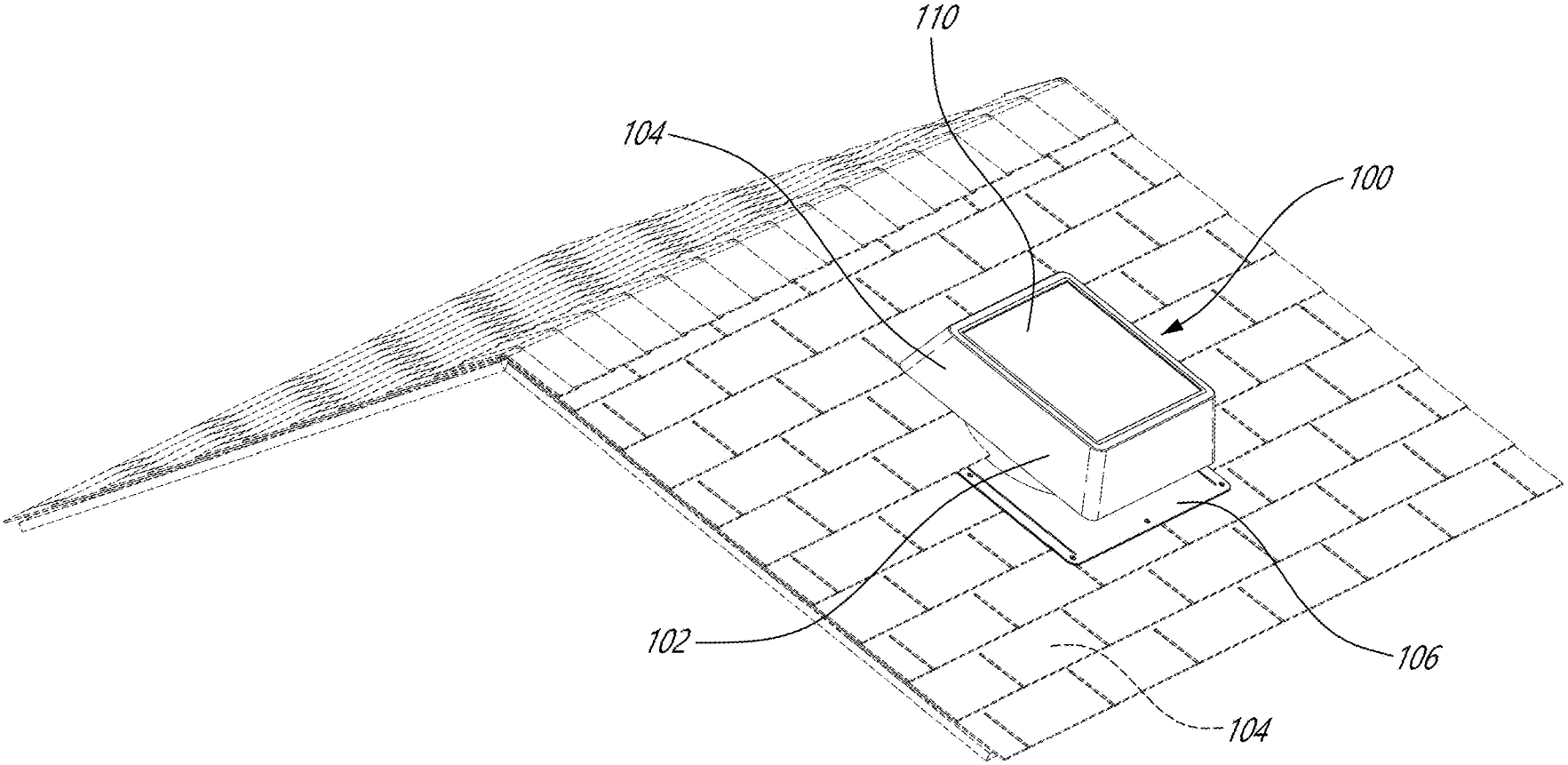
FIG. 1 is a perspective view of a roof vent having a solar panel and operably installed on a roof to provide active exhaust therethrough, in accordance with one embodiment.

Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiments are often not depicted in order to facilitate a less obstructed view of these various embodiments of the present disclosure.

DETAILED DESCRIPTION

Various implementations and aspects of the specification will be described with reference to details discussed below.

The following description and drawings are illustrative of the specification and are not to be construed as limiting the specification. Numerous specific details are described to provide a thorough understanding of various implementations of the present specification. However, in certain instances, well-known or conventional details are not described, in order to provide a concise discussion of implementations of the present specification.

Various apparatuses and processes will be described below to provide examples of implementations of the system disclosed herein. No implementation described below limits any claimed implementation and any claimed implementations may cover processes or apparatuses that differ from those described below. The claimed implementations are not limited to apparatuses or processes having all of the features of any one apparatus or process described below or to features common to multiple or all of the apparatuses or processes described below. It is possible that an apparatus or process described below is not an implementation of any claimed subject matter.

Furthermore, numerous specific details are set forth in order to provide a thorough understanding of the implementations described herein. However, it will be understood by those skilled in the relevant arts that the implementations described herein may be practiced without these specific details. In other instances, well-known methods, procedures and components have not been described in detail so as not to obscure the implementations described herein.

In this specification, elements may be described as "configured to" perform one or more functions or "configured for" such functions. In general, an element that is configured to perform or configured for performing a function is enabled to perform the function, or is suitable for performing the function, or is adapted to perform the function, or is operable to perform the function, or is otherwise capable of performing the function.

It is understood that for the purpose of this specification, language of "at least one of X, Y, and Z" and "one or more of X, Y and Z" may be construed as X only, Y only, Z only, or any combination of two or more items X, Y, and Z (e.g., XYZ, XY, YZ, ZZ, and the like). Similar logic may be applied for two or more items in any occurrence of "at least one . . . " and "one or more . . . " language.

Unless defined otherwise, all technical and scientific terms used herein have the same meaning as commonly understood by one of ordinary skill in the art to which this invention belongs.

Throughout the specification and claims, the following terms take the meanings explicitly associated herein, unless the context clearly dictates otherwise. The phrase "in one of the embodiments" or "in at least one of the various embodiments" as used herein does not necessarily refer to the same embodiment, though it may. Furthermore, the phrase "in another embodiment" or "in some embodiments" as used herein does not necessarily refer to a different embodiment, although it may. Thus, as described below, various embodiments may be readily combined, without departing from the scope or spirit of the innovations disclosed herein.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references unless the context clearly dictates otherwise. The meaning of "in" includes "in" and "on."

The term "comprising" as used herein will be understood to mean that the list following is non-exhaustive and may or may not include any other additional suitable items, for example one or more further feature(s), component(s) and/or element(s) as appropriate.

The systems and methods described herein provide, in accordance with different embodiments, different examples of an attic ventilation system, a roof vent therefor, and method of installation and servicing thereof. As will be described in greater detail below, an attic ventilation system will generally include a roof vent to be installed on a roof so to provide passive and/or active ventilation through the roof so to enhance air circulation in an underlying attic, for example, to exhaust or actively manage excess attic heat buildup or like temperature control, dispense of or provide active management for ambient humidity or air water vapor content levels, and like environmental conditions in the attic, for example, relevant or relative to external ambient environmental conditions.

With reference to FIG. 1, and in accordance with one exemplary embodiment, an attic ventilation system, generally referred to using the numeral 100, will now be described. As illustratively shown in FIG. 1, the attic ventilation system 100 comprises a roof vent 102 operatively mounted over an aperture formed in a roof 104 so to provide ventilation therethrough for an underlying attic. In this example, the roof 104 is shingled, and the roof vent comprises a lower flange portion 106 that can be secured under the shingles so to promote proper rain or water drainage to limit ingress of any water (or debris) from entering the attic through the formed aperture. In the illustrated example, the flange portion 106 is shown as being only partially covered by the surrounding shingles for illustrative purposes, only, and the person of ordinary skill in the art will appreciate that proper shingling and flashing techniques may be applied in the proper installation of this flange portion on a shingled roof to mitigate potential environmental issues, without departing from the general scope and nature of the present disclosure. Naturally, some of the aspects of products and methods described herein may also be applied to different roof types, and are thus not limited to the shingled roof example illustrated by FIG. 1.

Figure 2:
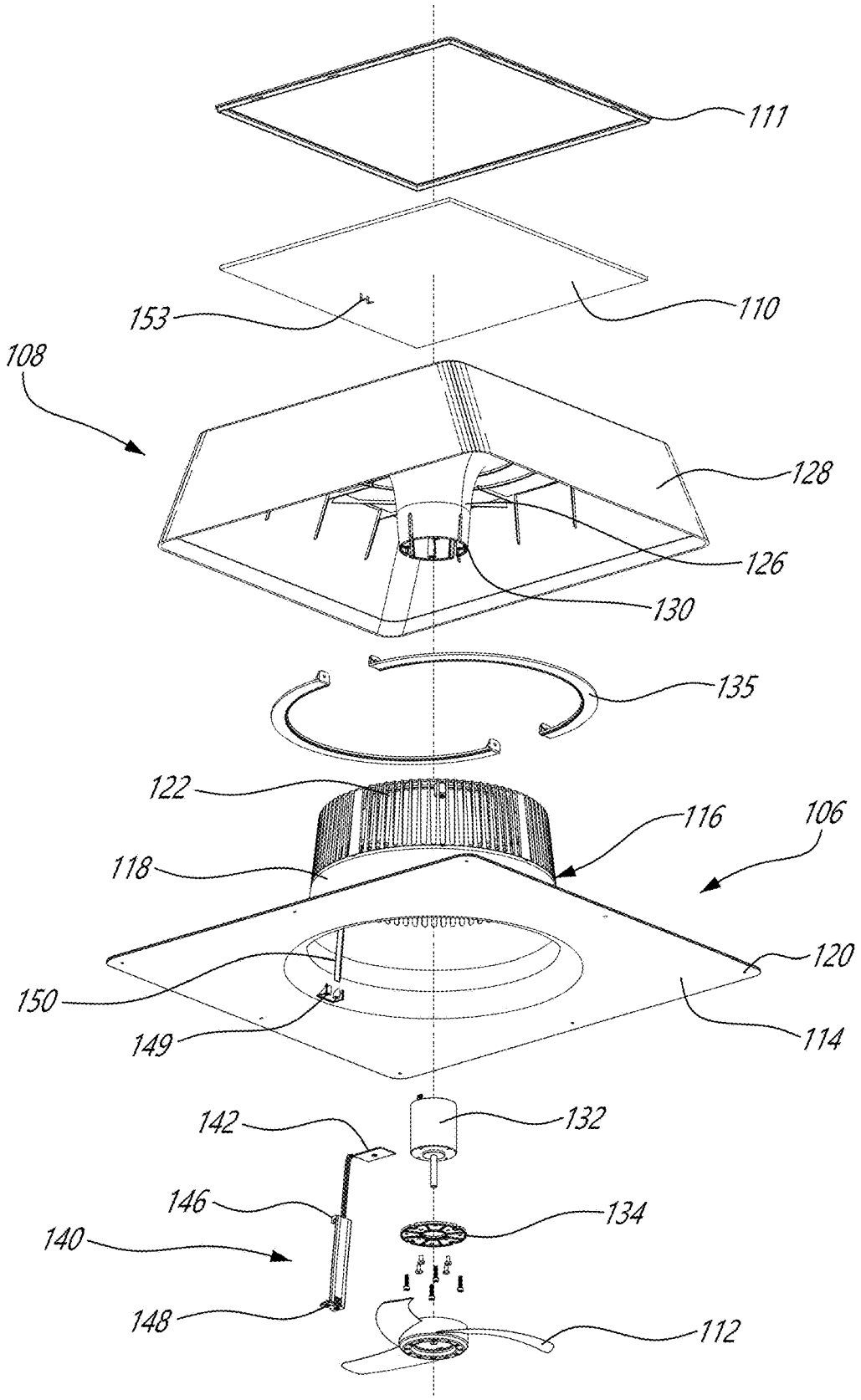
FIG. 2 is an exploded view of an assembly of the roof vent of FIG. 1, in accordance with one embodiment.
Figure 3:
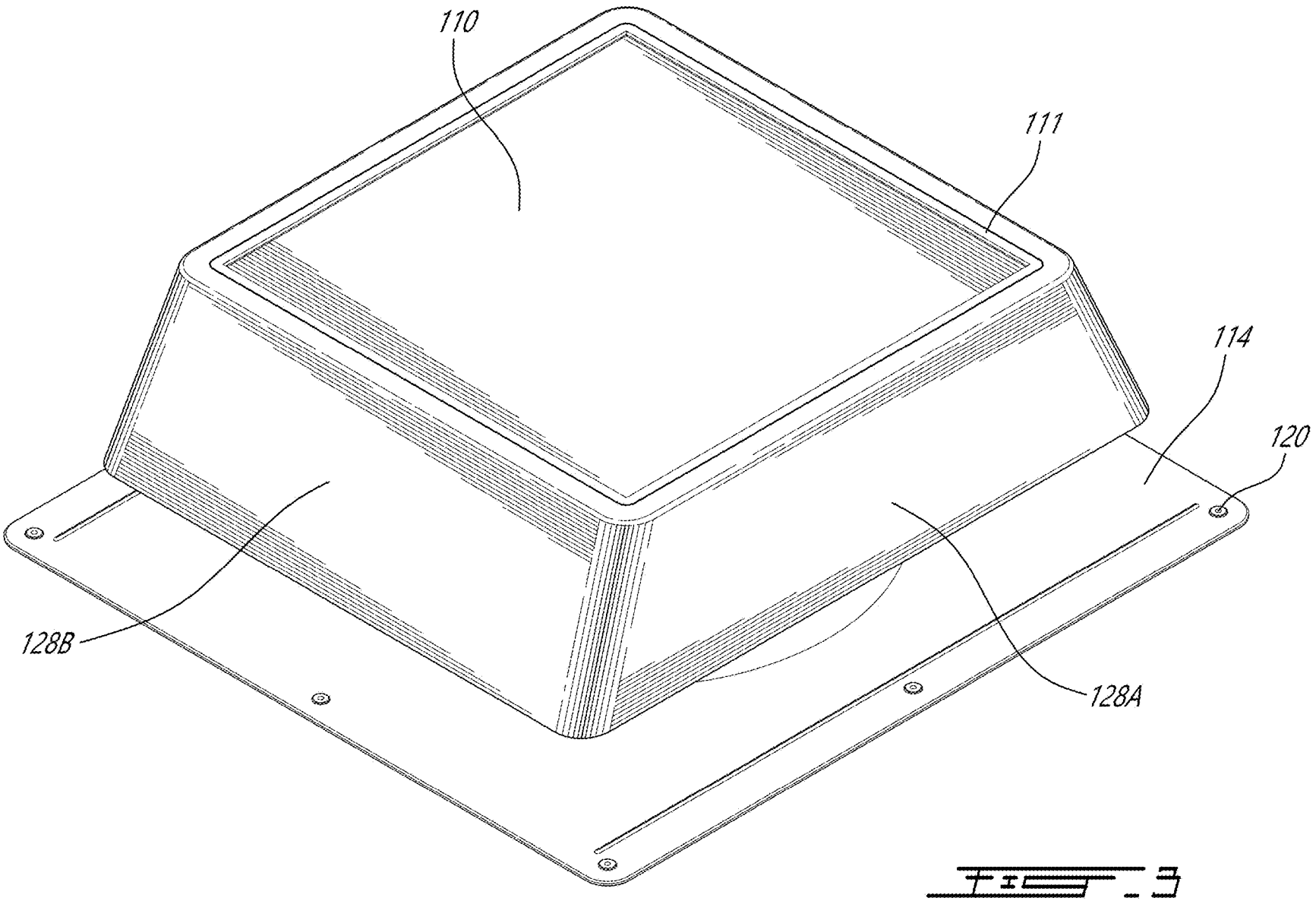
FIG. 3 is a top perspective view of the roof vent of FIG. 1, once assembled in accordance with the embodiment illustrated in FIG. 2.
Figure 4:
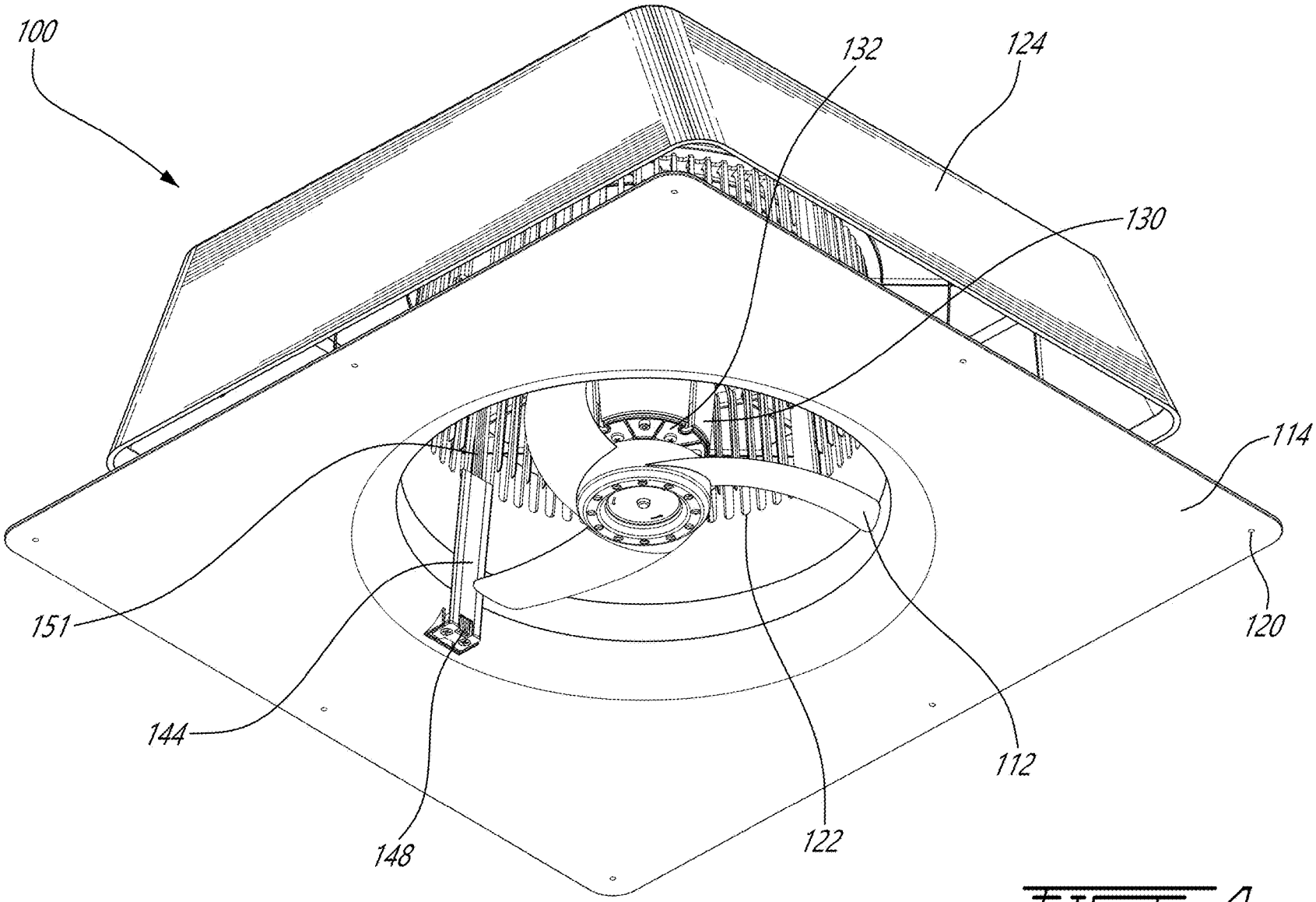
FIG. 4 is a bottom perspective view of the roof vent of FIG. 1, once assembled in accordance with the embodiment illustrated in FIG. 2.
Figure 7:
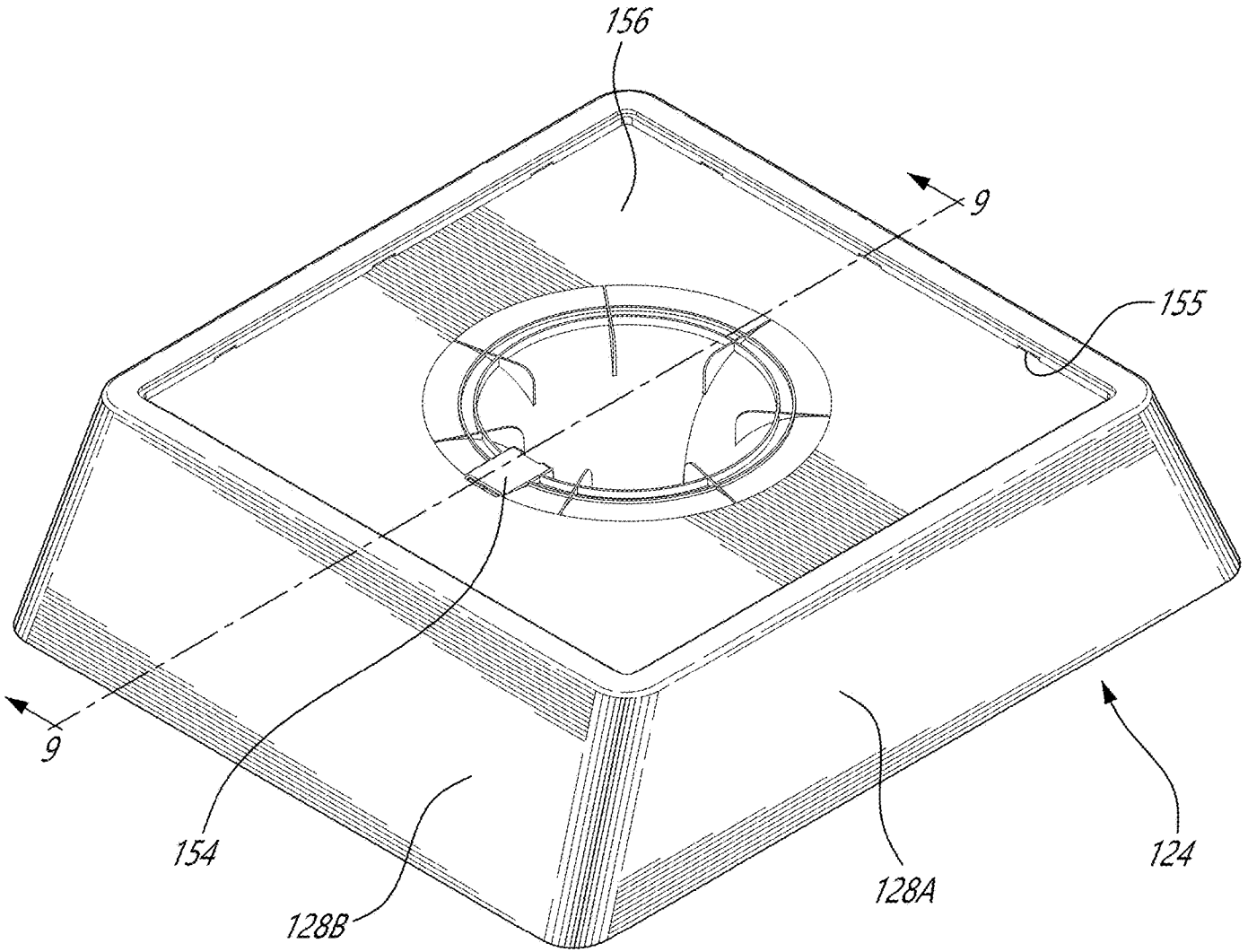
FIG. 7 is a top perspective view of a top housing of the vent of FIG. 1, with its solar panel removed, in accordance with one embodiment.
Figure 8:
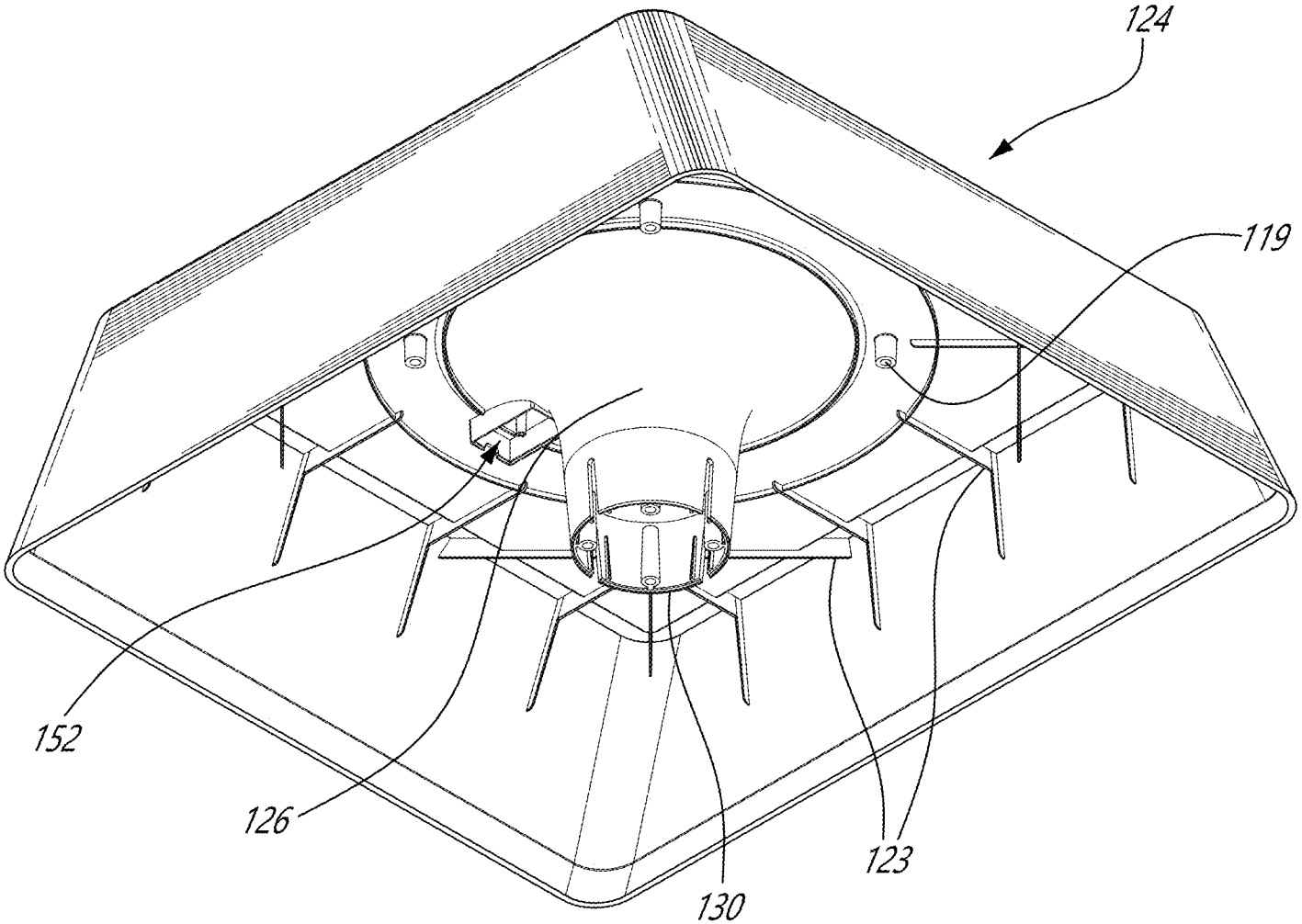
FIG. 8 is a bottom perspective view of the top housing of FIG. 7.

In the illustrated example, and with added reference to FIGS. 2 to 4, the roof vent 102 also comprises a top or upper housing assembly 108, generally forming a cap or like structure, securely mounted to the flange portion 106. In the illustrated embodiment, the upper housing 108 forms a powered unit comprising a solar panel 110 operatively mounted thereon to power active components of the roof vent 102, such as an active exhaust fan 112, as will be described in greater detail below. For example, the solar panel 110 can be bonded to an upper surface 156 (see FIG. 7) of the upper housing 108, and further secured using a solar panel trim 111 that can, in some examples, be snapped (e.g. see trim snap-in slots 155 of FIG. 7) and/or bonded (e.g. using a silicon adhesive/seal) in place. In the illustrated embodiment, the solar panel and trim sit substantially flush with upper housing edges.

As will be appreciated by the skilled artisan, while a solar-powered roof vent is described in the context of this illustrative embodiment, similar embodiments may be otherwise powered by a direct power connection or plug-in, battery, or like powering mechanisms, as can some of the advantages of the embodiments described herein be applied to passive roof vents, for example. These and other such examples are thus considered to fall within the general scope and nature of the present disclosure.

Figures 6, 6A:
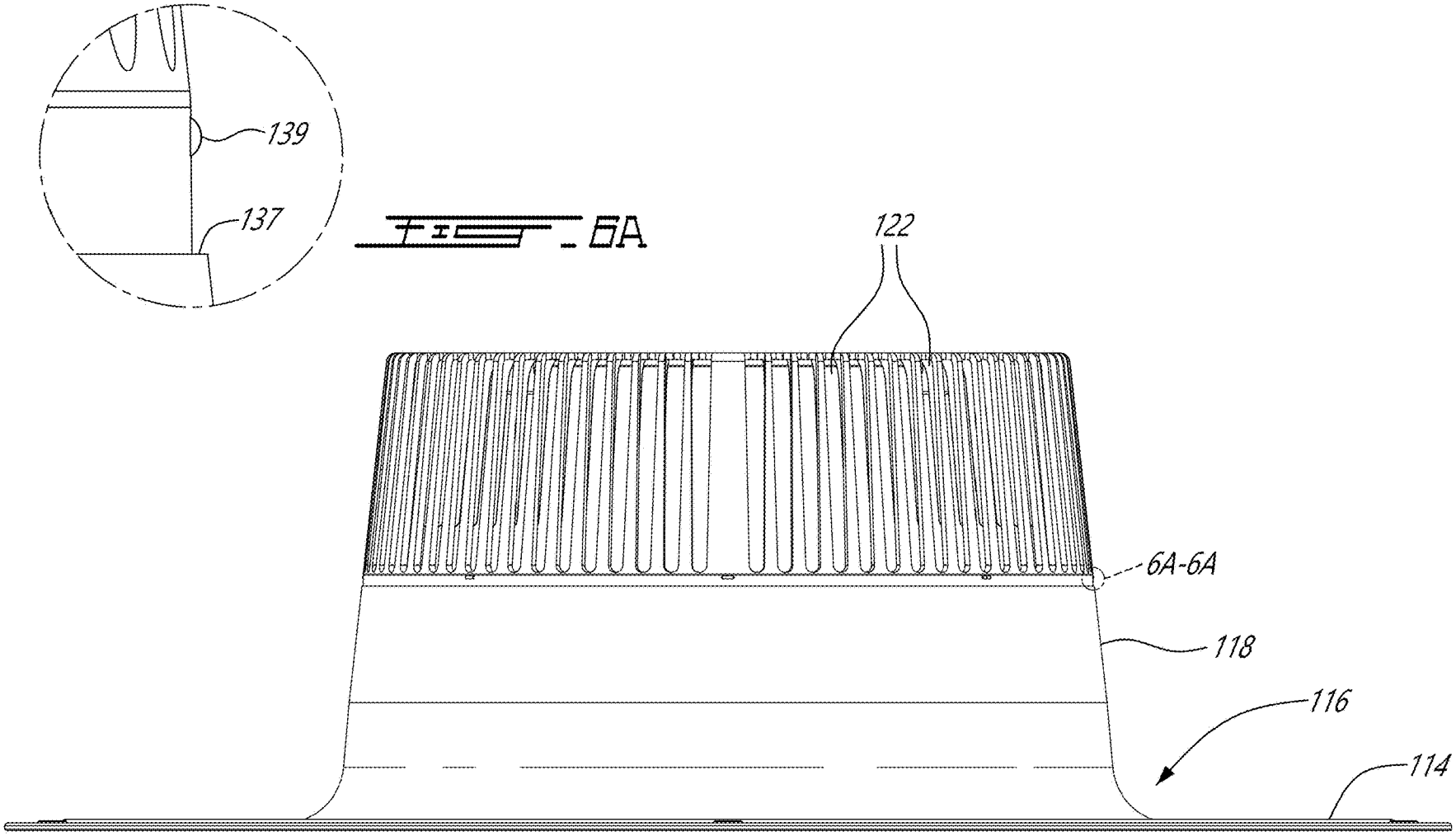

With particular reference to FIGS. 2 and 6, the lower flange portion 106 comprises a substantially planar roof-mounting surface 114 and ventilation channel-forming flashing portion 116 extending outwardly from the roof-mounting surface 114 to provide and thereby define and outer circumscribing vent channel wall, in this example, consisting of a substantially cylindrical outer vent channel wall 118. In this example, the roof-mounting surface 114 can be securely mounted to a roof structure using appropriate fasteners or the like through corresponding fastener apertures 120, as will be readily appreciated by the skilled artisan.

In this example, the vent channel wall 118 has defined therein a series of substantially axially aligned circumferentially spaced-apart ventilation openings, in this example formed as exhaust slits 122 or apertures, to provide for the egress of exhaust air/gas from the ventilation channel. The person of ordinary skill in the art will appreciate that different ventilation slit or aperture shapes, sizes and configurations may be considered in different embodiments, as can different ventilation channel shapes and sizes, without departing from the general scope and nature of the present disclosure.

With particular reference now to FIGS. 2, and 7 to 9, the top housing assembly 108 generally comprises a top housing 124 onto which the remaining operative components of the roof vent 102 can be operatively mounted. Illustratively, the top housing 124 defines a top surface portion externally upon which can be operatively mounted the solar panel 110, and that internally can be securely mounted to an outward extremity or apex of the vent channel 118. For example, fastener-receiving mounting channels 119, downwardly extending from an inner surface of the top housing 124, can be aligned and secured into corresponding mounting bores 121 formed in the top of the vent channel 118, such that corresponding fasteners and/or related hardware can be securely received therein from below to secure the top housing assembly 108.

The top housing 124 in this example also comprises an inwardly projecting exhaust guiding structure 126 that descends within the vent channel when the top housing assembly 108 is mounted thereto, as above, to redirect exhaust flowing therethrough to exhaust outwardly radially therefrom through the ventilation slits 122. The top housing 124 further comprises an outer lateral wall, in this example, forming an outwardly splaying square or rectangular outer squirt (see 128 of FIG. 2) that partially encases the ventilation channel so to minimize ingress of rain or debris within the ventilation channel in use while allowing for the ventilation of exhaust gases exiting the ventilation channel through the ventilation slits 122. In this example, the top housing skirt splays to form respective trapezoidal skirt walls, wherein a splaying of the skirt is more pronounced in directions toward the top and bottom of the roof, and less pronounced laterally. In other words, the trapezoidal side walls (see 128A of FIGS. 3 and 7) exhibit greater splayed angularity while forming a squarer surface angle with the top surface of the roof vent, whereas the top and lower trapezoidal side walls (see 128B of FIGS. 3 and 7) exhibit lesser splayed angularity while forming a more observable flaring surface angle relative to the top surface. In the illustrated embodiment, the top surface is also rectangular so to exhibit a longer vertical dimension than lateral dimension when installed on the roof. Naturally, a similar design may include other top housing shapes and sizes, such as square, rounded, circular, or oblong, to name a few examples, or other shapes as may be deemed desirable or preferable. A set of optional reinforcement ribs 123 are also provided in this embodiment so to increase a structural integrity of the housing, though other structural reinforcement mechanisms may be considered, as will be readily appreciated by the skilled artisan.

Figure 5:
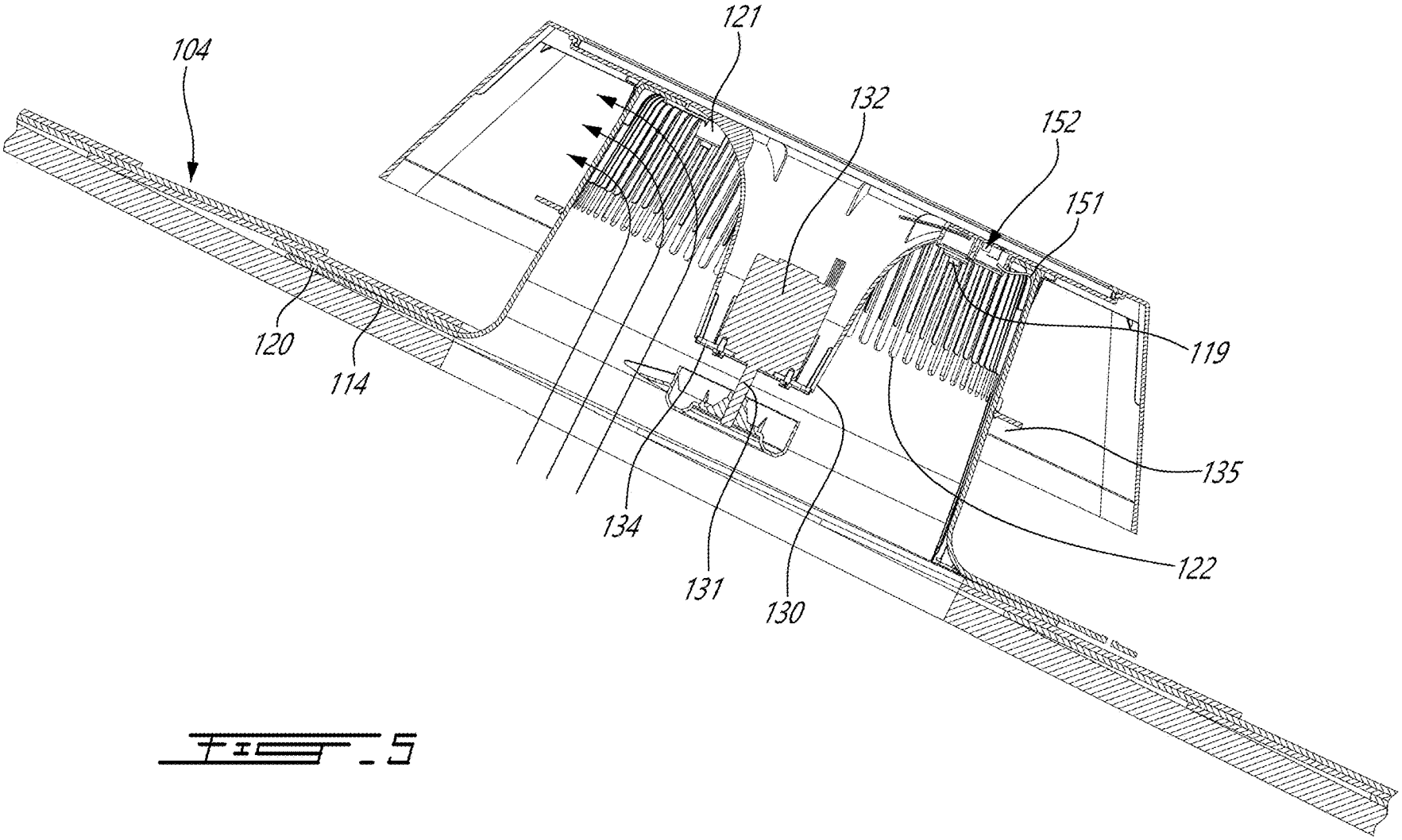
FIG. 5 is a side cross-sectional view of the roof vent of FIG. 1, once assembled in accordance with the embodiment illustrated in FIG. 2.

As best illustrated in FIGS. 2, 4 and 5, an exhaust fan assembly, generally comprising an exhaust fan 112 operated by an exhaust fan motor 132, is operatively mounted to ascend within the exhaust guiding structure 126, and thus be at least partially housed therein. In this particular example, the exhaust fan motor 132 is mounted recessed within the apex 130 of the guiding structure 126 and secured using a motor mounting plate 134 and corresponding fasteners that fasten into the apex to conveniently house the motor within the guiding structure. The exhaust fan 112 is operatively mounted (e.g. via a drive shaft 131) to hang below the motor mounting plate 134 (i.e. beyond the guiding structure apex) to draw, in operation, exhaust from the attic along the guiding structure and exit via the exhaust slits 122. For example, the exhaust fan can, in operation, hang toward the bottom of the outer vent channel wall 118, for example at a level around or slightly above the roof-mounting surface 114. In this configuration, the roof vent 102 can be pre-assembled for installation, with the exhaust fan 112 sitting recessed within the assembled structure.

Figure 9:
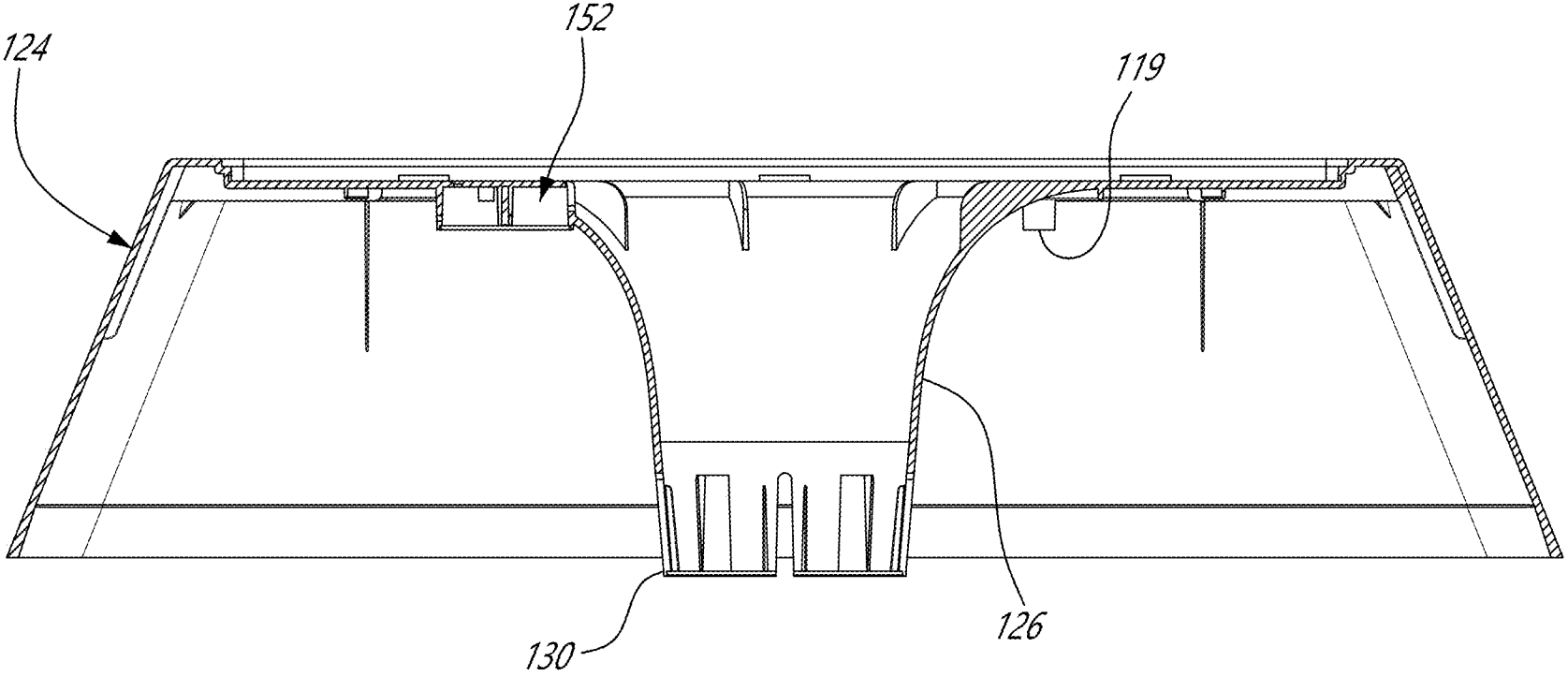
FIG. 9 is a side cross-sectional view of the top housing of FIG. 7, taken along line 9-9 thereof.

In this particular example, as best illustrated in FIGS. 5 and 9, the exhaust guiding structure 126 is shaped to promote or enhance a laminar exhaust flow whereby exhaust (e.g. warm air from the attic) is entrained by the exhaust fan to travel first substantially axially and progressively radially outward as it is guided laminarly by the exhaust structure to exit via the exhaust slits 122 and out from under the top housing 124. For example, in the illustrated embodiment, the exhaust guiding structure 126 comprises an external upwardly and outwardly concave surface that promotes laminar airflow along its surface to redirect the exhaust from its initial predominantly axial direction as it is drawn by the exhaust fan, to a predominantly radial direction, all while internally housing the exhaust fan motor 132, for example, within an internal apex of its illustratively curved internal funnel shape. Illustratively, the exhaust guiding structure can thus, in some embodiments, take the form of a curved funnel disposed so to laminarly guide exhaust airflow along its outer surface (see illustrative exhaust flow arrows of FIG. 5).

With particular reference to FIGS. 2 and 5, the roof vent assembly 102 further comprises a baffle ring, in this example consisting of two semi-circular ring members 135, that can be mounted to, or otherwise assembled or formed into the outer vent channel wall 118 to extend outwardly therefrom, for example at a level within the top housing outer wall 128 and below the exhaust slits 122, to prevent or reduce ingress of debris or water/moisture/snow/wind through the slits 122. For example, external wind gusts or airflow on the roof surface may entrain debris or moisture along and up the installed flange portion 106 and be obstructed by the baffle ring members 135 to reach and infiltrate the vent channel. This may be particularly useful in periods when the exhaust fan is off, for example, when active exhaust is deemed unnecessary or undesirable. As will be appreciated by the skilled artisan, different approaches to installing the baffle ring can be considered, such as a cooperating set of dimples, grooves, snaps, pressure fit or the like with or without adhesive/sealing silicon or like fastener/sealer. For example, see recessed lip 137 and retention nub 139 of FIG. 6A, shaped and disposed so to cooperatively engage the baffle ring member 135 in place.

With particular reference to FIGS. 2 and 4, the ventilation assembly 100 further comprises an (optional) integrated wire guide assembly 140 to guide sensor and/or controller wiring (not shown), that can be used to hang or otherwise dangle one or more environmental sensors and/or controllers (also not shown) within the attic and guide signals acquired and/or output thereby to a control board or the like configured to control operation of the exhaust fan motor 132 and fan 112. In the illustrated embodiment of FIG. 4, a wire guide structure 144 of the wire guide assembly 140 is secured to internally line the outer vent channel wall 118 so not to interfere with operation of the exhaust fan 112 while allowing a sensor and/or controller device to hang freely within the attic to capture environmental or like data. In particular, the wire guide structure 144 comprises a pair of hooks 146 that align and hook into corresponding slits 122 of the vent channel, while the lower part of the guide comprises an L-shaped foot 148 that can be securely fastened to the flange portion at coupling structure 149. Accordingly, wiring 151 can be channeled behind the wire guide structure 144 to pass through an appropriately sized aperture formed in the foot 148 while bypassing the turning blades of the fan 112. In the illustrate embodiment, a wire guiding channel 150 is further formed within the sidewall of the vent channel to permit further recess of any such wiring. At the other end, wiring 151 can be operatively coupled to a junction box, for example see junction box cover 142 of FIG. 2 and corresponding box 152 of FIG. 8, to which may also be guided wiring from the solar panel connectors 153 (see FIG. 2) via panel wire guide structure 154 (see FIG. 7).

As illustrated by the described embodiments, the outer housing (i.e. powered outer unit) can be dismounted from the flange portion for servicing without having to dismount the installed flange portion from the roof. This may be particularly helpful where the flange portion is carefully mounted to the roof, for example, where the flange portion acts as waterproofing flashing in a shingled roof installation. Unlike known installations, the re-flashing, caulking and/or other weather-resisting installation steps can be omitted in the servicing of the herein-described embodiments. Furthermore, a serviced or new upper housing can be remounted to an installed flange portion with minimal effort.

In some embodiments, a new roof ventilation system can be installed as a single assembled unit, and only partially disassembled (i.e. dismounting the outer housing and internally assembled components from the flange portion) for servicing or component replacement(s). In other embodiments, the flange portion can be independently installed with appropriate caulking, shingling etc., with the upper housing and its components later mounted thereto.

In the illustrated embodiments, a powered upper housing unit can be removed by first dismounting the fan from its shaft from within the attic, disconnecting the wire cover, and removing a set of fasteners that engage the upper housing through a mounting ring formed at the apex of the vent channel. The powered upper housing can then be pulled up and out from above. To install a new or serviced upper housing unit, the process is reversed whereby the unit is lowered into the vent channel until the upper housing rests on the apex mounting ring, through which a set of fasteners can be engaged to secure the upper housing in place; the fan is then mounted to its powered shaft, and wiring again secured by the wire guide (as needed). Other mounting, installation and/or servicing methods and techniques may also be considered within the scope of the present disclosure that may require more or less component disassembly and/or reassembly as the case may be, and that, without departing from the general scope and nature of the present disclosure.

While the present disclosure describes various embodiments for illustrative purposes, such description is not intended to be limited to such embodiments. On the contrary, the applicant's teachings described and illustrated herein encompass various alternatives, modifications, and equivalents, without departing from the embodiments, the general scope of which is defined in the appended claims. Except to the extent necessary or inherent in the processes themselves, no particular order to steps or stages of methods or processes described in this disclosure is intended or implied. In many cases the order of process steps may be varied without changing the purpose, effect, or import of the methods described.

Information as herein shown and described in detail is fully capable of attaining the above-described object of the present disclosure, the presently preferred embodiment of the present disclosure, and is, thus, representative of the subject matter which is broadly contemplated by the present disclosure. The scope of the present disclosure fully encompasses other embodiments which may become apparent to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are intended to be encompassed by the present claims. Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims. However, that various changes and modifications in form, material, work-piece, and fabrication material detail may be made, without departing from the spirit and scope of the present disclosure, as set forth in the appended claims, as may be apparent to those of ordinary skill in the art, are also encompassed by the disclosure.

What is claimed is:

1. A roof ventilation system to be mounted on a roof to draw exhaust airflow therethrough, comprising:

a flange portion defining a roof-mountable surface circumscribing an outwardly extending vent channel; and an outer housing disposed atop said flange portion relative to said vent channel obstructing external ingress of precipitation therein, said outer housing comprising operatively externally mounted thereon a solar panel for capturing solar energy, and a fan operatively internally mounted therein powered by said solar energy to draw said exhaust airflow through said vent channel;

wherein said outer housing is dismountably coupled to said flange portion for servicing without dismounting said flange portion from the roof;

wherein said outer housing comprises an inwardly projecting structure that, when said outer housing is mounted to said flange portion, extends inwardly within said vent channel so to permit said exhaust airflow to flow outwardly through a vent channel volume defined between a vent channel wall and an external surface of said inwardly projecting structure;

wherein said vent channel wall comprises a set of exhaust airflow apertures defined therein for permitting egress of said exhaust airflow therethrough, and wherein said external surface of said inwardly projecting structure comprises a concave surface shaped to laminarly redirect said exhaust airflow laterally toward said exhaust airflow apertures.

2. The roof ventilation system of claim 1, wherein said fan is operatively mounted toward an apex of said inwardly projecting structure to draw said exhaust airflow through said vent channel volume.

3. The roof ventilation system of claim 2, wherein said outer housing further comprises a motor operatively mounted within said inwardly projecting structure and powered by said solar energy to drive said fan through said apex.

4. The roof ventilation system of claim 1, wherein said inwardly projecting structure is defined by a curved funnel shape that defines said concave surface, and wherein said fan is operatively mounted at said apex to draw said exhaust airflow along said concave surface.

5. The roof ventilation system of claim 1, wherein said exhaust airflow apertures define a set of slits formed toward and around an apex of said vent channel.

6. The roof ventilation system of claim 1, wherein said outer housing comprises a circumscribing skirt extending downwardly around said vent channel beyond said exhaust airflow apertures so to further obstruct external ingress of precipitation therein.

7. The roof ventilation system of claim 1, wherein said vent channel is substantially cylindrical.

8. The roof ventilation system of claim 1, wherein said outer housing is dismountably secured toward an apex of said vent channel such that, upon dismounting of said outer housing, said internally projecting structure can be extracted along therewith from within said vent channel.

9. The roof ventilation system of claim 1, wherein said housing defines a cap upon which is operatively mounted said solar panel, and wherein said cap is mounted to an apex of said vent channel.

10. A method for servicing a roof ventilation system operatively mounted on a roof, comprising:

dismounting an outer housing of the roof ventilation system from a flange portion thereof without dismounting said flange portion from the roof, wherein said flange portion comprises a roof-mounted surface circumscribing an outwardly extending vent channel that remain mounted to the roof during servicing, and wherein said outer housing comprises an inwardly projecting structure that, when said outer housing is mounted to said flange portion, extends inwardly within said vent channel, and which houses a powered drive mechanism for driving an fan of the roof ventilation system;

extracting said inwardly projecting structure from within said vent channel thereby allowing for servicing of the drive mechanism housed therein;

reinserting said inwardly projecting structure within said vent channel upon remounting said outer housing post-servicing;

wherein said fan is operatively mounted at an apex of said inwardly projecting structure, and wherein the method further comprises, prior to said extracting, dismounting said fan from said apex so to permit said extracting.

11. The method of claim 10, wherein said outer housing defines a cap upon which is operatively mounted a solar panel for capturing solar energy, wherein said solar energy powers said powered drive mechanism, and wherein said dismounting comprises dismounting said cap from an apex of said vent channel.

12. A roof vent to be mounted on a roof to draw exhaust airflow therethrough, comprising:

a flanged roof-mountable vent channel; and an outer housing disposed relative to said vent channel to obstruct external ingress of precipitation therein, said outer housing comprising an inwardly projecting structure that extends inwardly within said vent channel so to permit said exhaust airflow to flow outwardly along an external surface of said inwardly projecting structure; and a fan operatively mounted toward an apex of said inwardly projecting structure to draw said exhaust airflow through said vent channel;

wherein said external surface of said inwardly projecting structure comprises a concave surface shaped to laminarly redirect said exhaust airflow.

13. The roof vent of claim 12, wherein said outer housing further comprises a motor operatively mounted within said inwardly projecting structure to drive said fan through said apex.

14. The roof vent of claim 12, wherein said inwardly projecting structure is defined by a curved funnel shape that defines said concave surface, and wherein said fan is operatively mounted at said apex to draw said exhaust airflow along said concave surface.

15. The roof vent of claim 12, wherein a circumscribing vent channel wall comprises a set of exhaust airflow apertures defined therein for permitting egress of said exhaust airflow therethrough, wherein said concave surface is shaped to laminarly redirect said exhaust airflow laterally toward said exhaust airflow apertures.

16. The roof vent of claim 15, wherein said exhaust airflow apertures define a set of slits formed toward and around an apex of said vent channel wall.

17. The roof vent of claim 15, wherein said outer housing comprises a circumscribing skirt extending downwardly around said vent channel beyond said exhaust airflow apertures so to further obstruct external ingress of precipitation therein.

18. The roof vent of claim 12, wherein said vent channel is substantially cylindrical.

19. The roof vent of claim 12, further comprising a solar panel externally mounted atop said outer housing to power said fan.

20. A roof vent to be mounted on a roof to draw exhaust airflow therethrough, comprising:

a flanged roof-mountable vent channel; and an outer housing disposed relative to said vent channel to obstruct external ingress of precipitation therein, said outer housing comprising an inwardly projecting structure that extends inwardly within said vent channel so to permit said exhaust airflow to flow outwardly along an external surface of said inwardly projecting structure; and a fan operatively mounted toward an apex of said inwardly projecting structure to draw said exhaust airflow through said vent channel;

wherein said outer housing further comprises a motor operatively mounted within said inwardly projecting structure to drive said fan through said apex.

21. The roof vent of claim 20, further comprising a solar panel externally mounted atop said external housing to power said fan.

22. A roof ventilation system to be mounted on a roof to draw exhaust airflow therethrough, comprising:

a flange portion defining a roof-mountable surface circumscribing an outwardly extending vent channel; and an outer housing disposed atop said flange portion relative to said vent channel obstructing external ingress of precipitation therein, said outer housing comprising operatively externally mounted thereon a solar panel for capturing solar energy, and a fan operatively internally mounted therein powered by said solar energy to draw said exhaust airflow through said vent channel;

wherein said outer housing is dismountably coupled to said flange portion for servicing without dismounting said flange portion from the roof;

wherein said outer housing comprises an inwardly projecting structure that, when said outer housing is mounted to said flange portion, extends inwardly within said vent channel so to permit said exhaust airflow to flow outwardly through a vent channel volume defined between a vent channel wall and an external surface of said inwardly projecting structure;

wherein said fan is operatively mounted toward an apex of said inwardly projecting structure to draw said exhaust airflow through said vent channel volume; and wherein said outer housing further comprises a motor operatively mounted within said inwardly projecting structure and powered by said solar energy to drive said fan through said apex.

23. The roof ventilation system of claim 22, wherein said outer housing is dismountably secured toward an apex of said vent channel such that, upon dismounting of said outer housing, said internally projecting structure can be extracted along therewith from within said vent channel for servicing at least one of said motor or a related drive mechanism without dismounting said flange portion from the roof.

24. The roof ventilation system of claim 23, wherein said fan is dismountably secured to said motor such that it can be dismounted therefrom prior to extraction of said internally projecting structure from said vent channel.

25. The roof ventilation system of claim 23, wherein a serviced outer housing or a new outer housing can be remounted to an installed flange portion.

* * * * *